United States Patent [19]

Burrow

[11] 4,026,354

[45] May 31, 1977

[54] APPARATUS FOR SHUTTING OFF AND CONTROLLING WELL BLOWOUTS

[76] Inventor: Melvin Burrow, P.O. Box 127, Rte. No. 1, Tryon, Okla. 74875

[22] Filed: May 5, 1975

[21] Appl. No.: 575,048

[52] U.S. Cl. ..... 166/95; 285/DIG. 13

[51] Int. Cl.[2] ..... E21B 33/03

[58] Field of Search ..... 166/78, 95; 285/DIG. 13; 251/1 R, 1 A

[56] References Cited

UNITED STATES PATENTS

| | | | |
|---|---|---|---|
| 2,070,326 | 2/1937 | Weidinger | 166/95 |
| 2,139,207 | 12/1938 | Rector | 166/95 |
| 2,897,895 | 8/1959 | Ortloff | 166/95 |
| 2,946,386 | 7/1960 | Jones | 166/95 |

*Primary Examiner*—James A. Leppink
*Attorney, Agent, or Firm*—Robert M. Hessin

[57] ABSTRACT

The present invention relates to apparatus for temporary attachment to the top of a conduit string disposed in a well bore whereby an uncontrolled fluid blowout through the conduit string can be shutoff and controlled utilizing the apparatus. The apparatus includes a housing having a central bore disposed therethrough and a side connection formed therein communicating with the bore. A vent is sealingly attached to the top of the housing over the bore and shutoff valve means are disposed in the vent. A tubular member, the upper end of which is rotatably and sealingly disposed within the bore of the housing projects below the bottom of the housing and means are formed on the lower end of the tubular member for sealingly gripping the inside surfaces of the top of the conduit string upon the rotation of the tubular member. Gear means are disposed within the housing and attached to the upper end of the tubular member for rotating the tubular member and a conduit is sealingly connected to the side connection of the housing adapted to be connected to a source of weighted fluid for killing the well. A drive shaft is disposed within the conduit, the forward end of which is operably connected to the gear means, and means for imparting axial rotation to the drive shaft are attached to the conduit and operably connected to the rearward end of the drive shaft.

8 Claims, 9 Drawing Figures

APPARATUS FOR SHUTTING OFF AND CONTROLLING WELL BLOWOUTS

BACKGROUND OF THE INVENTION

1. Field of the Invention

The present invention relates to apparatus for shutting off and controlling well blowouts, and more particularly, but not by way of limitation, to apparatus for temporary attachment to the top of a well conduit string during an uncontrolled well fluid blowout whereby the well fluid flow can be shutoff and drilling mud or other weighted fluid for killing the well pumped through the apparatus and into the well.

2. Description of the Prior Art

Many various methods and apparatus have been devised for shutting off and controlling well blowouts. In drilling well bores into subterranean fluid producing formations it is common practice to circulate drilling mud through the drill string to the bottom of the well bore and upwardly through the annulus between the drill string and the walls of the well bore. The function of the drilling mud, among others, is to lubricate the drill bit, to carry cuttings produced by the drill bit to the surface where they are separated from the drilling mud and to exert sufficient hydraulic pressure on the bottom of the well bore so that pressurized fluids contained in formations through which the well bore is drilled are prevented from flowing into the well bore. In order to insure the drilling mud exerts sufficient pressure on the bottom of the well bore to prevent formation fluids from flowing into the well bore, weighting materials are commonly added to the drilling mud to increase the density thereof. However, in spite of this and other precautions taken by the operators of well bore drilling apparatus, blowouts often occur. That is, a formation is penetrated by the drill bit containing fluids, e.g. natural gas, under a pressure sufficient to overcome the hydrostatic head exerted on the well bore by the drilling mud, which fluids travel up the annulus between the drill string and the well bore. In severe cases, the pressurized formation fluids force the drilling mud out of the well bore, blow out through apparatus at the ground surface and catch fire. Such blowouts and ensuing fires generally melt the surface drilling equipment and the resulting uncontrolled flow of well fluids and fire are extremely difficult to shutoff and extinguish.

Heretofore developed and used blowout preventer apparatus are not always effective in stopping a blowout, and consequently, elaborate and extremely expensive techniques are often necessary to bring a blowout under control. For example, where a blowout has occurred and the well fluids ae burning, explosives are often used to extinguish the fire followed by the placement of elaborate shutoff apparatus on the casing or conduit string through which the blowing out fluids are flowing. Once the flow of well fluids has been shutoff, a high density weighted drilling mud or other fluid must be pumped into the well bore to kill the well, i.e. terminate the flow of formation fluids into the well bore.

By the present invention relatively simple, inexpensive apparatus is provided for temporary attachment to the top of a conduit string disposed in a well bore during a blowout to shutoff the flow of fluids through the conduit and kill the well.

SUMMARY OF THE INVENTION

The present invention relates to apparatus for temporary attachment to the top of a conduit string disposed in a well bore whereby an uncontrolled well fluid blowout through the conduit string can be shutoff and controlled comprising a housing having a top, bottom and sides, a bore disposed therethrough from the top to the bottom, and a side connection formed therein communicated with said bore. A vent is sealingly attached to the top of the housing over the bore and shutoff valve means are disposed in the vent. A tubular member having the upper end thereof rotatably and sealingly disposed within the bore of the housing with the lower end thereof projecting below the bottom of the housing is provided and means are formed on the lower end of the tubular member for sealingly gripping the inside surfaces of the top of the conduit string upon the rotation of the tubular member. Gear means are disposed within the housing and are attached to the upper end of the tubular member for axially rotating the tubular member in response to rotation imparted thereto from a direction transverse to the axis of the tubular member and a conduit is sealingly connected to the side connection of the housing adapted to be connected to a source of weighted fluid for killing the well. A drive shaft is disposed within the conduit the forward end of which is operably connected to the gear means within the housing and means for imparting axial rotation to the drive shaft are attached to the conduit and operably connected to the rearward end of the drive shaft.

It is, therefore, a general object of the present invention to provide apparatus for shutting off and controlling well blowouts.

A further object of the present invention is the provision of apparatus for temporary attachment to the top of a conduit string disposed in a well bore through which an uncontrolled well fluid blowout is flowing.

Yet a further object of the present invention is the provision of relatively simple and inexpensive apparatus which can temporarily be attached to the top of a conduit string disposed in a well bore and used to shutoff an uncontrolled well fluid blowout flowing through the conduit string as well as to route weighted fluid into the well bore for killing the well.

Another object of the present invention is the provision of apparatus for temporary attachment to the top of a conduit string disposed in a well bore whereby a uncontrolled fluid blowout through the conduit string can be shutoff and controlled, which apparatus is relatively easily and inexpensively attached to the top of the conduit string even in the case where the blowing out well fluids are burning and the top of the conduit has melted down.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a side elevational and sectional view of an alternate arrangement of apparatus of the present invention.

DESCRIPTION OF PREFERRED EMBODIMENTS

Figure 1:
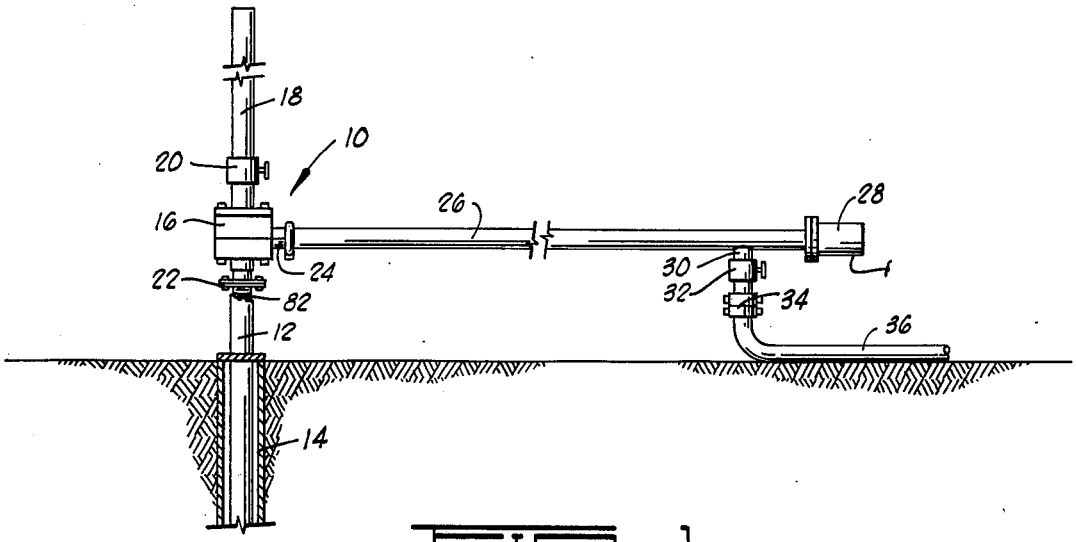
FIG. 1 is a partially sectional view of a well bore having a conduit string disposed therein with the apparatus of the present invention installed in the top of the conduit string.
Figure 2:
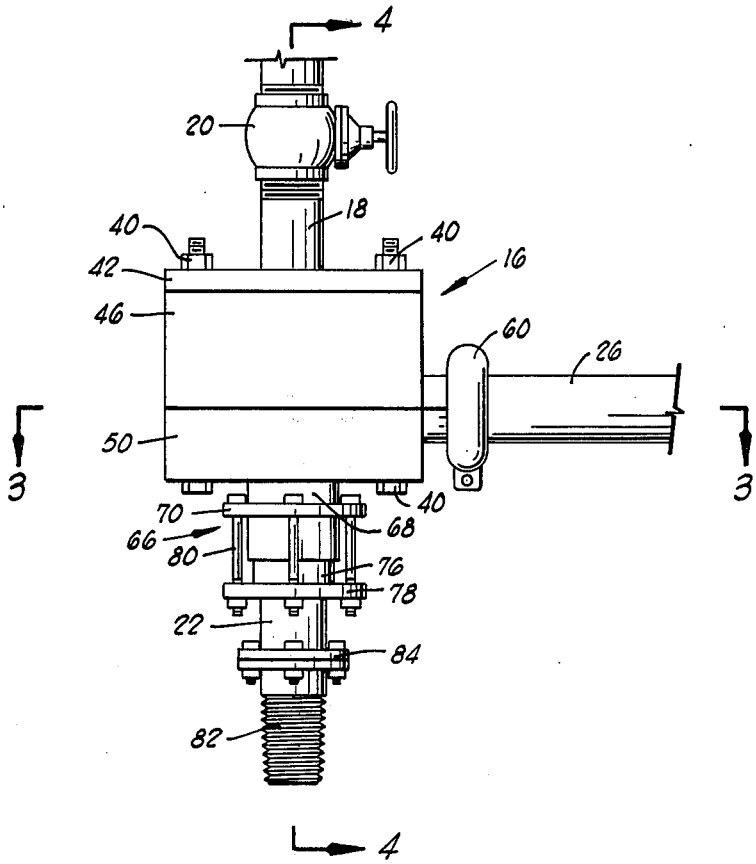
FIG. 2 is a side elevational view of the apparatus of the present invention.

Referring now to the drawings and particularly to FIG. 1, the apparatus of the present invention is illustrated and generally designated by the numeral 10. The apparatus 10 is shown installed in the top of a conduit string 12 disposed in a well bore 14. The apparatus 10 basically comprises a housing 16 having a length of conduit or vent 18 attached to the top thereof which includes a shutoff valve 20 disposed therein. The vent 18 is communicated by way of the housing 16 with a tubular member 22, the top end of which is rotatably disposed within the housing 16 and the bottom end of which includes means for gripping the inside surfaces of the top of the conduit string 12 when rotated. The housing 16 further includes a side connection 24 also communicated with the tubular member 22. A conduit 26 is attached to the side connection 24 of the housing 16 and an electric motor 28 is sealingly attached to the conduit 26 and to a shaft disposed within the conduit 26 for rotating the tubular member 22 as will be described further hereinbelow. The conduit 26 includes a connection 30 having a shutoff valve 32 disposed therein. The conduit 30 is connected by means of a conventional hose connection or other conventional connection 34 to a hose or conduit 36. The hose or conduit 36 is connected to a source of weighted fluid which is pumped through the conduit 26, the housing 16 and the tubular member 22 into the well bore 14 by way of the conduit string 12 to kill the well as will be described further hereinbelow.

Referring now specifically to FIGS. 2 through 5 the apparatus 10 is shown in greater detail. The housing 16 is preferably formed of a plurality of steel plates held together by means of a plurality of bolts 40. More specifically, a top rectangular plate 42 is provided having a bore 44 (FIG. 4) centrally positioned therein. The vent 18, which is preferably an elongated length of steel pipe, is sealingly attached to the plate 42, such as by welding, over the bore 44 therein. The shutoff valve 20 can be any of a variety of high temperature resistant steel valves and is disposed in the vent 18 in a conventional manner such as by threads or flanges. As will be understood, the valve 20 can be equipped with any of a variety of conventional remotely controlled operators if desired. A relatively thick rectangular plate 46 is positioned below the top plate 42 and includes a centrally positioned vertical bore 48 disposed therein of a size and position coinciding with the bore 44 of the plate 42. A bottom plate 50 is positioned below the plate 46 which also includes a central vertical bore 52 positioned in alignment with the bores 48 and 44 of the plates 46 and 42, respectively. Thus, the housing 16 includes a vertical bore extending from the top to the bottom thereof.

Figure 3:
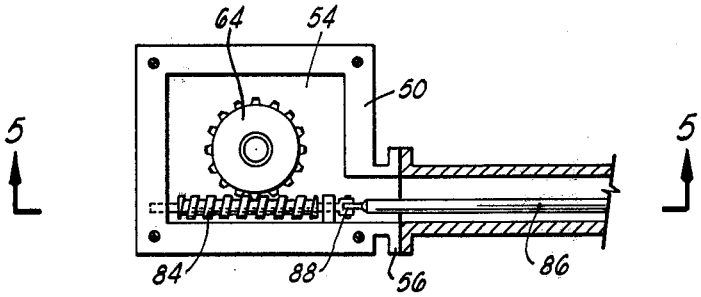
FIG. 3 is a sectional view taken along line 3—3 of FIG. 2.
Figure 4:
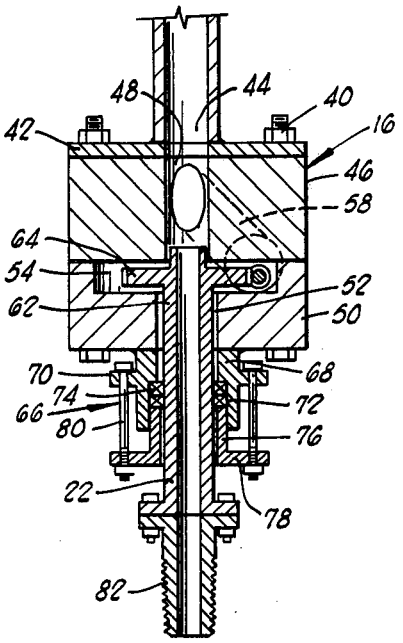
FIG. 4 is a sectional view taken along line 4—4 of FIG. 2.

As shown best in FIGS. 3 and 4, the bottom plate 50 includes a rectangular recess 54 in the top surface therein which forms an enlarged rectangular hollow portion within the housing 16. A side connection 56 (FIGS. 3 and 5) is integrally formed in the plates 48 and 50 and is positioned so that the connection 56 opens into the recess 54 formed in the plate 50. The plate 46 includes a bore 58 which extends from the side connection 56 to the bore 48 thereby communicating the side connection 56 with the bore 48. The conduit 26 is sealingly attached to the side connection 56 of the housing 16 in a conventional manner such as by means of a clamp 60 (FIG. 1).

The top end portion 62 of the tubular member 22 is rotatably disposed within the bore 52 of the plate 50 and includes a wheel gear 64 attached thereto and positioned transversely to the axis of the tubular member 22. A conventional packing gland assembly 66 is provided attached to the bottom of the housing 16 through which the tubular member 22 is disposed. As will be understood by those skilled in the art, a variety of conventional seal means can be utilized in place of the packing gland 66 which will provide a seal between the outside surfaces of the tubular member 22 and the bore 52 of the plate 50. The conventional packing gland 66 illustrated in the drawings includes a cylindrical housing 68 sealingly attached to the bottom of the plate 50 over the bore 52 such as by welding. The housing 68 includes an outwardly extending flange portion 70, and as best shown in FIG. 4, a recess 72 within which conventional packing material 74 is disposed. A cylindrical packing compressor sleeve 76 is positioned over the tubular member 22 and within the recess 72 of the housing 68 and includes an annular flange 78. A plurality of bolts or studs 80 are positioned through apertures disposed in the flange 70 of the housing 68 and the flange 78 of the compressor sleeve 76 which holds the compressor sleeve within the recess 72 of the housing 68 and against the packing material 74. As is well understood, the bolts 80 are tightened to a degree which causes the packing compressor sleeve 76 to compress the packing material within the recess 72 bringing about a seal between the outside surfaces of the tubular member 22 and the housing 68 while still allowing the tubular member 22 to rotate.

The lower end of the tubular member 22 is provided with means for sealingly gripping the inside surfaces of the top end of a conduit upon the rotation of the tubular member 22. More specifically, in the embodiment illustrated in FIGS. 2 through 5, the lower end portion 82 of the tubular member 22 includes a downwardly extending taper having helical threads formed thereon so that the end portion 82 can be readily inserted in the open top of a conduit string and upon rotation of the tubular member 22, the helical threads bite into the inside surfaces of the conduit and move the end portion 82 downwardly therein until a rigid seal results. The lower end portion of the tubular member 22 is connected to the upper portion thereof by a conventional flange connection 84 to facilitate the installation of different sizes of end portions 82 thereon and the removal of the apparatus 10 from the end portion 82 when desired.

Figure 5:
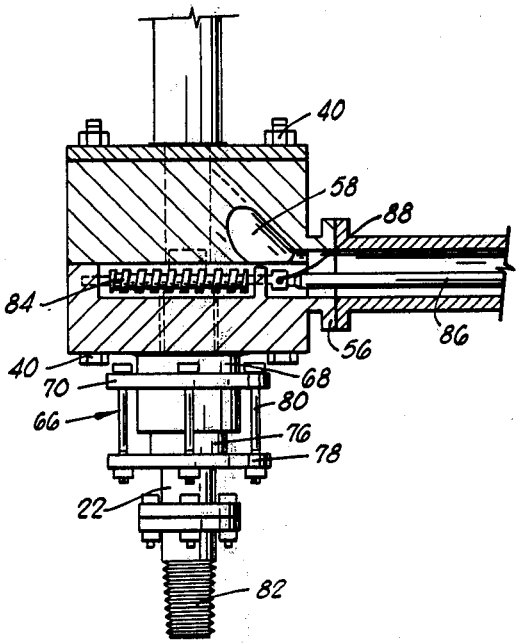
FIG. 5 is a sectional view taken along line 5—5 of FIG. 3.
Figure 5:
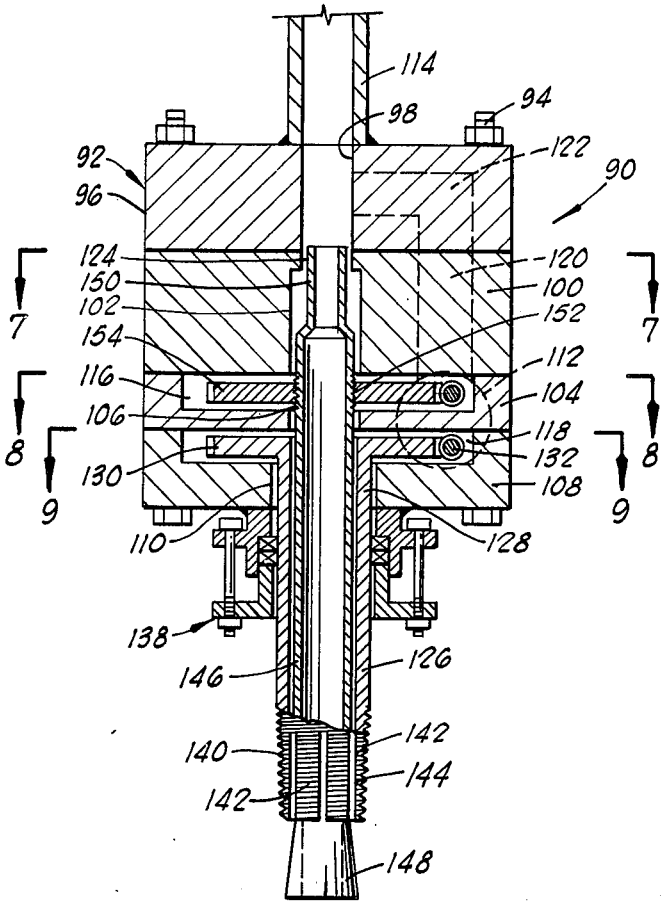

As best shown in FIGS. 3 through 5, the wheel gear 64 attached to the upper end portion 62 of the tubular member 22 is operably engaged by a worm gear rotatably disposed within the recess 54 of the bottom plate 50. A drive shaft 86 is disposed within the conduit 26, the forward end of which is connected to the worm gear 84 by means of a conventional universal joint 88. As mentioned above in connection with FIG. 1, the electric motor 28, which is preferably a bi-direction explosive-proof electric motor is sealingly connected to the end of the conduit 26 and is operably connected to the other end of the drive shaft 86 in a convention manner.

OPERATION OF THE APPARATUS 10

In operation of the apparatus 10, when a well blowout occurs, the blowing out well fluids exit either the drill string or casing through an opening at the ground surface. When the blowout results in a fire, the surface apparatus is quickly melted down and the well fluids generally escape through an open end of a conduit extending a short distance off the ground surface. The apparatus 10 is utilized to shutoff the escaping well fluids and to provide a means for routing weighted fluid into the well bore to kill the well. More specifically, the apparatus 10 is positioned over the end of the conduit string 12 (FIG. 1) with the lower end portion 82 of the tubular member 22 extending into the open top end of the conduit string 12. As will be understood, when the apparatus 10 is positioned over the conduit string 12, the valve 20 is open so that fluids excaping through the conduit string 12 are caused to flow through the tubular member 22, the housing 16, the valve 20 and the vent 18. The force of the escaping fluids tends to move the apparatus 10 upwardly when being positioned over the conduit string 12, but because the fluids can flow through the apparatus 10 and escape to the atmosphere through the top of the vent 18, the apparatus 10 can be positioned and held over the conduit string 12 using the boom of a crane of other similar equipment. Once the apparatus 10 has been positioned with the lower end portion 82 of the tubular member 22 extending into the top open end of the conduit string 12, the electric motor 28 is caused to rotate the drive shaft 86 and the worm gear 84 engaged with the wheel gear 64 in a direction so that the threaded portion 82 of the tubular member 22 is screwed into the conduit string 12. That is, the helical threads formed on the end portion 82 of the tubular member 22 are caused to bite into the inside surfaces of the top of the conduit string 12 whereby a rigid fluid-tight seal between the conduit string 12 and the tubular member 22 results. Once the tubular member 22 has been engaged with the conduit string 12, the fluids escaping through the conduit string 12 are caused to flow through the vent 18 and are discharged to the atmosphere from the top end of the vent 18 a considerable distance above the ground surface. This allows the shutoff valve 20 to be safely operated and the flow of fluids escaping from the conduit string 12 shutoff.

After shutting off the escaping fluids, the valve 32 is opened and weighted fluid is pumped by way of the hose or conduit 36 through the conduit 26, through the bore 58 disposed within the housing 16, through the bore 48 in the housing 16 and through the tubular member 22 into the conduit string 12. As is well understood, the weighted fluid is continuously pumped into the well bore 14 until a hydrostatic head of sufficient pressure is exerted on the bottom of the well bore to kill the well, i.e. shut off the flow of formation fluids into the well bore.

Referring now to FIGS. 6 through 9 an alternate embodiment 90 of the apparatus of the present invention is illustrated. The apparatus 90 is similar to the apparatus 10 in that it includes a housing 92 formed of rectangular plates rigidly held together by a plurality of bolts 94. That is, the housing 92 is comprised of a top plate 96 which includes a centrally positioned bore 98, a plate 100 positioned below the plate 96 which includes a centrally positioned bore 102, a plate 104 positioned below the plate 100 which includes a centrally positioned bore 106 and a bottom plate 108 which includes a centrally positioned bore 110. A side connection 112 is formed in the housing 92 which is connected to an elongated conduit (not shown) similar to the conduit 26 described above and adapted to be connected to a source of weighted drilling fluid. A vent 114 similar to the vent 18 described above and including a shutoff valve (not shown) is sealingly attached to the top plate 96 over the bore 98 thereof.

Each of the plates 104 and 108 include rectangular recesses 116 and 118, respectively, in the upper surfaces thereof which form rectangular spaces within the housing 92 when assembled in the manner illustrated in FIG. 6. The recesses 116 and 118 are communicated with the side connection 112 of the housing 92 and the plates 100 and 96 include aligned bores 120 and 122, respectively, forming a passageway leading from the side connection 112 of the housing 92 to the bore 98 of the top plate 96.

Figure 9:
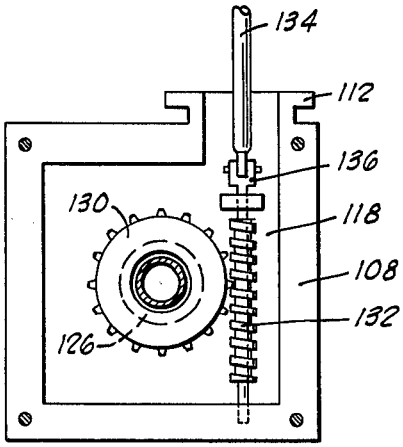
FIG. 9 is a sectional view taken along line 9—9 of FIG. 6.

The top end portion 124 of the bore 102 disposed in the plate 100 is of square shape with the remaining lower portion being of enlarged cylindrical shape. A first tubular member 126 is provided, the upper end portion 128 of which is rotatably disposed within the bottom plate 108. A wheel gear 130 is attached to the top end of the first tubular member 126 and is positioned transversely to the axis thereof within the recess 118 formed in the plate 108. As best shown in FIGS. 6 and 9, a worm gear 132 is rotatably disposed within the recess 118 to operably engage the wheel gear 130. A first drive shaft 134 is connected to the worm gear 132 by means of a conventional universal joint 136. As will be understood, the drive shaft 134 is positioned within the elongated conduit (not shown) connected to the side connection 112 of the housing 90 and means for rotating the shaft 134 in a desired direction, such as an electric motor, is attached to the conduit and the the rearward end of the drive shaft. A conventional packing gland assembly 138 similar to the packing gland assembly 66 described above in connection with the apparatus 10 is sealingly attached to the bottom of the plate 108 over the bore 110 thereof so that a seal is provided between the outside surfaces of the first tubular member 26 and the housing 92 preventing fluids from escaping from the housing 92 by way of the bore 110.

The lower end portion 140 of the first tubular member 126 includes a downwardly extending taper with helical threads formed thereon. In addition, the end portion 140 includes a plurality of vertically positioned splines 142 positioned around the lower periphery thereof which are formed by a plurality of vertical grooves 144.

Figure 7:
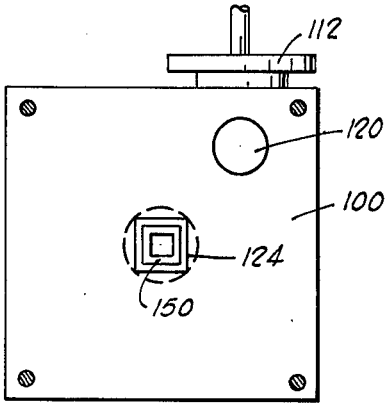
FIG. 7 is a sectional view taken along line 7—7 of FIG. 6.
Figure 8:
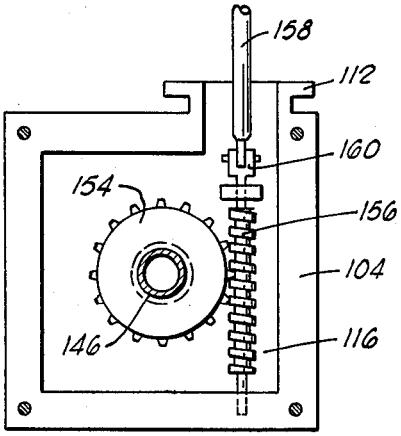
FIG. 8 is a sectional view taken along line 8—8 of FIG. 6.

A second tubular member 146 is slidably disposed within the first tubular member 126. The lower end portion 148 of the second tubular member is flared outwardly in a conical shape so that upon the upward movement of the second tubular member 146 within the first tubular member 126, the splines 142 at the lower end portion 140 of the first tubular member are caused to be moved outwardly. The top end portion 150 of the second tubular member 146 is formed of a square shape as illustrated in FIG. 7 and is of a size such that a close fit is provided between the outside surfaces of the top portion 150 of the second tubular member and the square opening 124 in the plate 100. Thus, the second tubular member 146 is prevented from rotating by its square top end shape and the square opening 124 in the plate 100, but is free to move vertically. The portion of the second tubular member 146 below the square shaped upper end portion 150 is cylindrical in shape and helical threads 152 are disposed on the outside surfaces thereof at a point below the upper end portion 150 thereof. A wheel gear 154 having a threaded central portion adapted to engage the threads 152 on the second tubular member 146 is positioned transversely to the axis of the member 146 within the recess 116 with the threaded central portion thereof engaging the threads 152. Thus, rotation of the wheel gear 154 raises or lowers the second tubular member 146 within the first tubular member 126. A worm gear 156 is rotatably disposed in the recess 116 of the plate 104 in a manner whereby it operably engages the wheel gear 154. A second drive shaft 158 is provided, the forward end of which is connected to the worm gear 156 by a conventional universal connection 160. As will be understood, both the first drive shaft 134 and second drive shaft 158 are disposed within the conduit connected to the side connection 112 of the housing 92. The second drive shaft 158 is connected to second means for selectively rotating the drive shaft 158 such as a second electric motor sealingly attached to the conduit.

OPERATION OF THE APPARATUS 90

The operation of the apparatus 90 is similar to the operation of the apparatus 10 described above in that the apparatus 90 is positioned over the top open end of the conduit string 12 with the lower end portion 140 of the first tubular member 126 and flared portion 148 of the second tubular member 146 positioned within the top of the conduit string 12. The means for rotating the shaft 134 are operated to cause the rotation of the shaft 134 and worm gear 132 attached thereto in a direction such that the wheel gear 130 and first tubular member 126 are rotated and the helical threads disposed on the lower end portion of of the member 126 caused to bite into the inside surfaces of the top of the conduit string 12 whereby the tubular member 26 is rigidly connected to the inside surfaces. The means for rotating the shaft 158 are next operated to cause the shaft 158 and the worm gear 156 connected thereto to rotate in a direction whereby the wheel gear 154 is rotated on the threads 152 of the second tubular member 146 raising the tubular member 146 within the tubular member 126. As the second tubular member 146 is raised, the flared lower end portion 148 thereof causes the splines 142 at the lower end portion 140 of the first tubular member 126 to be forced outwardly into rigid engagement with the inside surfaces of the conduit string 12 whereby the tubular member 126 is rigidly and sealingly connected to the conduit string 12. After connection of the apparatus 90 is accomplished, the apparatus 90 is operated in the same manner as described above in connection with the apparatus 10, i.e., the shutoff valve disposed in the vent 114 is closed thereby shutting off the flow of fluids blowing out of the conduit string 12 followed by pumping weighted drilling fluid through the conduit attached to the side connection 112 of the housing 92, through the passageway formed by the bores 120 and 122 of the plates 100 and 96, through the bore 98 of the plate 96 and through the second tubular member 146 into the conduit string 12 and well bore 14.

Thus, the apparatus of the present invention is well adapted to carry out the objects and attain the ends and advantages mentioned as well as those inherent therein. While presently preferred embodiments of the invention have been described for purposes of this disclosure, numerous changes in the construction and arrangement of parts will readily suggest themselves to those skilled in the art, which changes are encompassed within the spirit of this invention as defined by the appended claims.

What is claimed is:

1. Apparatus for temporary attachment to the top of a conduit string disposed in a well bore whereby an uncontrolled fluid blowout through said conduit string can be shut off and controlled which comprises:

a housing having a top, bottom and side, a bore disposed therethrough from the top to the bottom, and a side connection formed therein communicated with said bore;

a vent sealingly attached to the top of said housing over said bore;

shutoff valve means disposed in said vent;

a tubular member having an upper end and a lower end, the upper end being rotatably and sealingly disposed within said bore of said housing with the lower end thereof extending below the bottom of said housing;

means attached to the lower end of said tubular member for sealingly gripping the inside surfaces of the top of said conduit string upon the rotation of said tubular member;

gear means disposed within said housing and attached to the upper end of said tubular member for axially rotating said tubular member in response to rotation imparted thereto from a direction transverse to the axis of said tubular member;

a conduit sealingly connected to said side connection of said housing and adapted to be connected to a source of weighted fluid for killing said well;

a drive shaft disposed within said conduit having a forward end and a rearward end, the forward end being operably connected to said gear means within said housing; and means for imparting axial rotation to said drive shaft attached to said conduit and operably connected to the rearward end of said drive shaft.

2. The apparatus of claim 1 which is further characterized to include a shutoff valve disposed in said conduit.

3. The apparatus of claim 2 wherein said gear means comprises:

a wheel gear attached to said tubular member positioned in a plane transverse to the axis of said tubular member; and a worm gear operably engaged with said wheel gear and connected to said drive shaft.

4. The apparatus of claim 3 wherein said means for sealingly gripping the inside surfaces of the top of said conduit string comprise:

the lower portion of said tubular member including a taper terminating at the lower end thereof; and helical threads formed on the lower portion of said tubular member and said taper.

5. Apparatus for temporary attachment to the top of a conduit string disposed in a well bore whereby an uncontrolled fluid blowout through said conduit string can be shut off and controlled which comprises:

a housing having a top, bottom and sides, a bore disposed therethrough from the top to the bottom, and a side connection formed therein communicating with said bore;

a vent sealingly attached to the top of said housing over said bore;

shutoff valve means disposed in said vent;

a first tubular member having an upper end and a lower end, the upper end being rotatably and sealingly disposed within said bore of said housing with the lower end thereof extending below the bottom of said housing and including a splined downward taper having helical threads formed thereon;

first gear means disposed within said housing and attached to the upper end of said first tubular member for axially rotating said tubular member in response to rotation imparted thereto from a direction transverse to the axis of said tubular member;

a second tubular member having upper and lower ends slidably disposed within said first tubular member, the lower end of said second tubular member extending below the lower end of said first tubular member and being flared outwardly so that when said second tubular member is moved axially upwardly within said first tubular member the flared lower end thereof forces the splined portions of the lower end of said first tubular member outwardly;

second gear means disposed within said housing and operably connected to the upper end of said second tubular member for moving said second tubular member axially within said first tubular member in response to rotation imparted thereto in a direction transverse to the axis of said second tubular member;

a conduit sealingly connected to said side connection of said housing and adapted to be connected to a source of weighted fluid for killing said well;

a first drive shaft disposed within said conduit having a forward end and a rearward end, the forward end being operably connected to said first gear means within said housing;

first means for imparting axial rotation to said first drive shaft attached to said conduit and operably connected to the rearward end of said drive shaft;

a second drive shaft disposed within said conduit having a forward end and a rearward end, the forward end being operably connected to said second gear means within said housing; and second means for imparting axial rotation to said second drive shaft attached to said conduit and operably connected to the rearward end of said second drive shaft.

6. The apparatus of claim 5 which is further characterized to include a shutoff valve disposed in said conduit.

7. The apparatus of claim 6 wherein said first gear means comprises:

a wheel gear attached to said first tubular member positioned in a plane transverse to the axis of said tubular member; and a worm gear operably engaged with said wheel gear and connected to said first drive shaft.

8. The apparatus of claim 7 wherein said second gear means comprises:

the upper end of said second tubular member including helical threads disposed around the sides thereof;

a wheel gear having a threaded central portion adapted to threadedly engage said helical threads on the upper end of said second tubular member and positioned in a plane transverse to the axis of said second tubular member, the central portion thereof being threadedly engaged with the upper end of said second tubular member; and a worm gear operably engaged with said wheel gear and connected to said second drive shaft.

* * * * *